US007503078B2

(12) United States Patent
Bernard et al.

(10) Patent No.: US 7,503,078 B2
(45) Date of Patent: Mar. 17, 2009

(54) BODY-PROTECTING ADHESIVE-BACKED FABRIC PATCH FOR USE WITH GARMENTS

(75) Inventors: Jo Ann Bernard, La Jolla, CA (US); Brian K. Phillips, La Jolla, CA (US)

(73) Assignee: The Commandos Group, Inc., La Jolla, CA (US)

( * ) Notice: Subject to any disclaimer, the term of this patent is extended or adjusted under 35 U.S.C. 154(b) by 47 days.

(21) Appl. No.: 11/330,367

(22) Filed: Jan. 11, 2006

(65) Prior Publication Data

US 2006/0288463 A1 Dec. 28, 2006

Related U.S. Application Data

(60) Provisional application No. 60/693,341, filed on Jun. 23, 2005.

(51) Int. Cl.
*A41B 9/00* (2006.01)

(52) U.S. Cl. ..... 2/46; 2/400; 2/406

(58) Field of Classification Search ..... 2/46, 2/60, 406, 53, 56–58, 401, 55, 62, 47, 54, 2/67, 69, 400, 402, 403, 267; 604/385.04, 604/385.01, 387; D2/860, 705; 128/891
See application file for complete search history.

(56) References Cited

U.S. PATENT DOCUMENTS 142,875 A * 9/1873 Sibley ..... 2/53
717,830 A * 1/1903 Ferguson ..... 2/53
1,048,727 A * 12/1912 Nevin ..... 2/53
1,478,907 A * 12/1923 Ogden ..... 2/53
2,004,511 A * 6/1935 Souther, Jr. ..... 2/53
2,685,086 A * 8/1954 Henry ..... 2/55
2,688,751 A * 9/1954 Kermode ..... 2/53
3,145,391 A * 8/1964 Tyrrell, Jr. ..... 2/56
3,397,697 A * 8/1968 Rickard ..... 604/370

(Continued)

FOREIGN PATENT DOCUMENTS

GB 2292669 6/1996

OTHER PUBLICATIONS

Anon., "going commado," Wikipedia on-line encyclopedia, www.nswers.com/topic/goingcommando, Internet, Aug. 19, 2005 [Hard copy enclosed].
Bodnar, "Why it Pays to Ditch Your Panties," Cosmopolitan Magazine, Aug. 2005, p. 186, USA.

*Primary Examiner*—Amy B Vanatta
(74) *Attorney, Agent, or Firm*—Gordon & Rees LLP

(57) ABSTRACT

An article called a tibbidy is disclosed to be attached to an outer garment and provide comfort and protection to the person wearing the garment when the person chooses not to wear inner- or undergarments beneath the garment. The article is a lightweight flexible fabric pad which is configured to conform to the inner surface of a garment, such as the inseam and crotch of a pair of pants or the axillary area of a shirt garment. The product has a soft comfortable top layer, optionally an intermediate supporting layer for the top layer, and an adhesive layer for adhesion to the inner surface of the garment. The product exists in various embodiments, some of which are specifically configured for use by women, others for use by men, and others of a "unisex" configuration for use by both men and women.

2 Claims, 5 Drawing Sheets

U.S. PATENT DOCUMENTS 3,616,156 A * 10/1971 Scholl ..... 428/163
3,727,237 A * 4/1973 Glatt ..... 2/56
3,885,247 A * 5/1975 Kost ..... 2/55
4,134,399 A * 1/1979 Halderson ..... 128/888
4,581,771 A * 4/1986 Williams ..... 2/408
4,653,119 A * 3/1987 Kaiser ..... 2/60
4,900,319 A * 2/1990 Richwine ..... 604/385.04
4,900,320 A * 2/1990 McCoy ..... 604/387
4,972,525 A 11/1990 Hwang
5,221,275 A * 6/1993 Van Iten ..... 604/387
D342,368 S * 12/1993 Gibson ..... D2/860
5,388,275 A 2/1995 Oram
5,429,633 A * 7/1995 Davis et al. ..... 604/387
5,545,157 A * 8/1996 Van Iten ..... 604/385.04
5,570,471 A * 11/1996 Krawchuk ..... 2/53
5,636,377 A 6/1997 Wiener
6,178,557 B1 * 1/2001 Bel Monte ..... 2/60
D440,308 S * 4/2001 Ibrahim ..... D24/125
6,275,996 B1 8/2001 Redwood et al.
6,312,418 B1 * 11/2001 Shimizu et al. ..... 604/385.04
6,681,407 B2 * 1/2004 Martz ..... 2/400
D504,509 S * 4/2005 Lavash ..... D24/124
D543,622 S * 5/2007 Lash et al. ..... D24/124
2003/0221236 A1 * 12/2003 Hippensteel ..... 2/46
2004/0068244 A1 * 4/2004 Salone et al. ..... 604/385.04
2007/0150995 A1 * 7/2007 Luna ..... 2/53

* cited by examiner

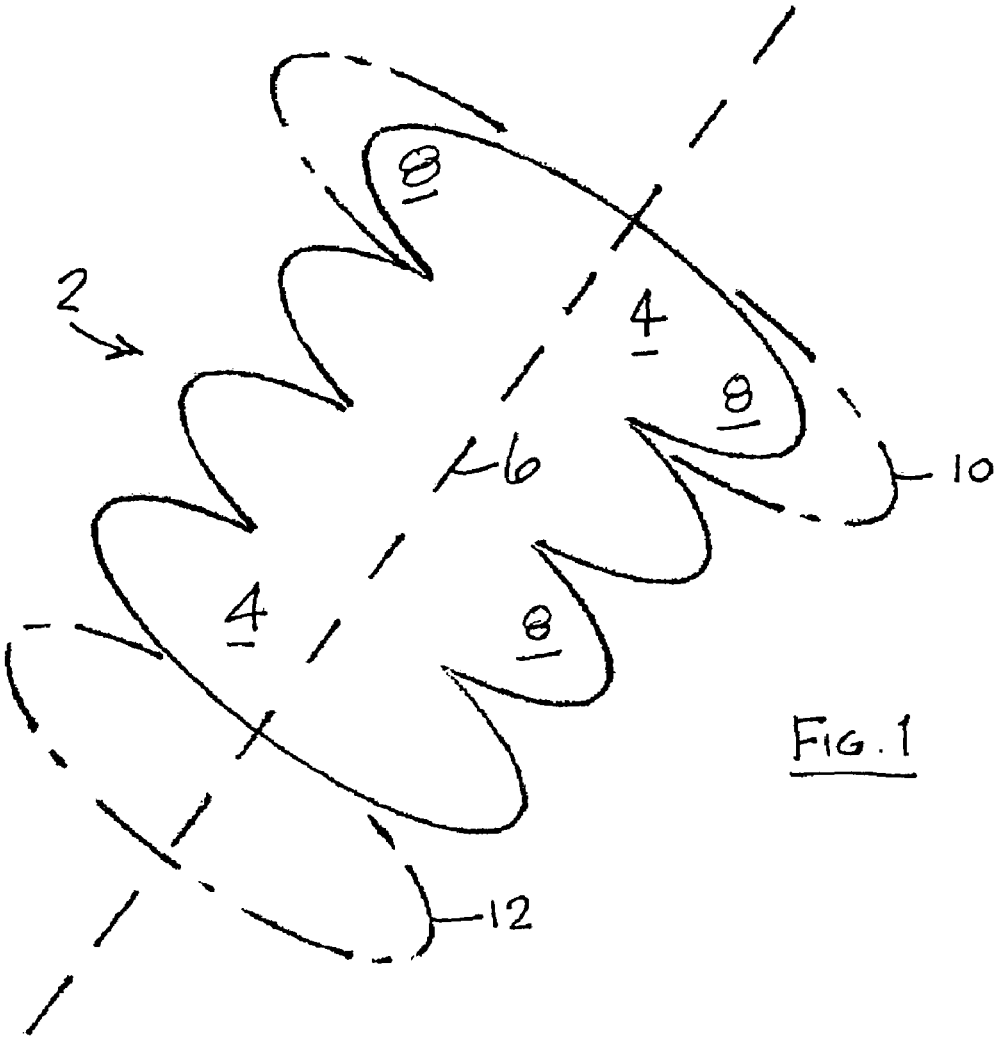
FIG. 1
FIG. 2
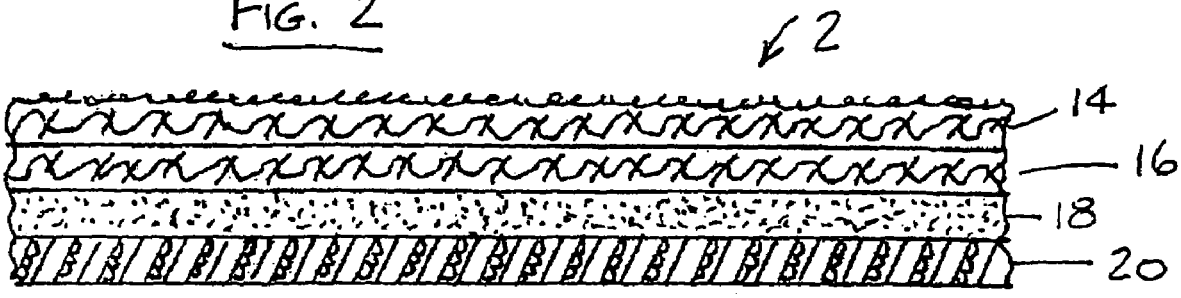

BODY-PROTECTING ADHESIVE-BACKED FABRIC PATCH FOR USE WITH GARMENTS

CROSS-REFERENCE TO RELATED APPLICATION

This application claims the benefit of Provisional Patent Application Ser. No. 60/693,341, filed on Jun. 23, 2005, of similar title.

BACKGROUND OF THE INVENTION

1. Field of the Invention

The invention herein relates to clothing for men and women, and in particular relates to an article or device to be attached to an outer garment and provide comfort and protection to the person wearing the garment when the person chooses not to wear undergarments (or other inner garments) under the outer garment.

2. Background of the Invention

Current clothing fashions, particularly for women, often dictate tightly fitting, low slung and/or low-rise outer garments, particularly pants or shorts. Wearing of such garments often causes portions of the wearer's underwear to be exposed or revealed as the wearer walks, bends, or otherwise moves about. In other instances where the wearer's undergarments (underwear) are not directly revealed, tightly fitting or thin fabric garments frequently reveal the outline of the undergarments, commonly referred to as disclosing a "panty line." This exposure or outlining of the undergarments is considered objectionable by many wearers. In order to avoid the exposure or outlining of undergarments, minimal sized undergarments such as thong undergarments have been marketed and used by many wearers. However since even such minimal undergarments are subject to exposure or outlining, although to a lesser degree than regular undergarments, such exposure or outlining is still considered objectionable by some wearers.

In addition, there are persons who for reasons of perceived comfort or simply personal preference do not like to wear undergarments. Thus, whether for personal choice, comfort, appearance or other reasons, numerous people have elected to dispense with the wearing of undergarments entirely, to the extent that dispensing with the wearing of undergarments has recently become a significant social trend, and is commonly referred to as "going commando", "freeballing" or "freebuffing." See, for instance, published reports in the "Wikipedia" on-line Internet encyclopedia at http://www.answers.com/topic/going-commando and in *Cosmopolitan* magazine (p. 186: August 2005).

However, those who have dispensed with their underwear frequently have found that direct contact of sensitive areas of the person's skin which are thus placed in direct contact with the inner surface of the person's outer garments may become irritated, such that the person finds it uncomfortable to have dispensed with the undergarments. At least one commercial product has been marketed which purports to address the problem of discomfort when one dispenses with undergarments. That product is intended to be attached to the inner surface of an outer garment at the point where the wearer would otherwise experience skin discomfort or irritation in the absence of the undergarments. It has been found that the stiffness and shape of that commercial product are such that the product can often disengage from the garment's inner surface and itself become attached directly to the wearer's skin upon such disengagement. This adhesive attachment to the wearer's skin causes significant discomfort to the wearer and can also cause significant injury to the wearer's skin by tearing or abrading the skin surface.

There exist minimal undergarments such as thongs or athletic supporters. Further, there also exist "disposable" undergarments which are intended to be worn once in a normal manner and then be disposed of rather than being washed and reworn. Similarly, there have in the past been what have been called "garment shields." Such products, which were once popular for use with women's blouses or jackets, were themselves underwear or inner garments, in that they were small individual garments suspended by shoulder straps and worn between a woman's axillary area and the inner surface of the sleeve/torso seam region of the blouse or jacket. Other types of garment shields were sown into and were parts of the garments themselves. Additionally, there exist "panty liners" which are sanitary products which are attached to the inner crotch of female underpanties to absorb and retain menstrual or other vaginal discharges, and then be discarded and, if need be, replaced after a limited period of such absorption. It will be evident that the invention described herein differs significantly from any of these products.

It is therefore a purpose of the present invention to provide a product which a person who wishes to dispense with wearing of undergarments can use in conjunction with his or her outer clothing to provide comfort to sensitive skin areas where underwear or other inner garment would otherwise have provided a barrier between such skin areas and contact with the inner surface of the outer garments.

It is also an object of the present invention to provide for a product which a person can use in conjunction with his or her outer clothing for those bodily areas where an undergarment is not conventionally worn, also to provide comfort to sensitive skin areas which would be in contact with the inner surface of the outer garments even when underwear or other inner garments may be being worn on other parts of the body.

It is also a purpose of the present invention to provide such a product which will avoid or minimize disengagement from the outer garment and subsequent harmful and/or uncomfortable adhesive contact with the wearer's skin.

BRIEF SUMMARY OF THE INVENTION

The articles of the present invention are neither undergarments nor garment shields and are not to be equated to undergarments or garment shields. Indeed, they are not "garments" at all, as they are not configured to be worn on a person's body (such as by having arm- or leg-holes for the wearer's limbs to protrude through) nor are they integrated into garments. Rather they represent what we believe to be an entirely new type of personal garment adjunct, not previously included in any garment-related categories. As a novel and unique product class, there has of course been no name previously assigned. Consequently, we have coined the term "tibbidy" (plural: "tibbidies") for the class name of the articles. That term when used herein shall be taken to refer to individual articles, a plurality of the articles or to the class of articles as a whole, as the context shall demand.

The tibbidy product of the present invention is a lightweight fabric article which is configured to be flexible and to conform to the various curves of the inner surface of a garment, such as to the inner surface of the inseam and crotch of a pair of pants, such as jeans. The product is in the form of a multilayer flexible pad or patch with a soft comfortable top pad (preferably made of cotton), preferably an intermediate supporting member for the top pad, and an adhesive layer on the opposite side of the supporting member for adhesion to the inner surface of the outer garment. A removable release layer is normally placed over the outer surface of the adhesive layer when the product is manufactured and packaged to prevent the adhesive from adhering to the packaging. The release layer is removed by the wearer after the individual product is removed from the packaging to be used, thus exposing the adhesive for attachment to the garment surface.

The product exists in various embodiments, some of which are primarily configured for use by women, others for use by men, and others of a "unisex" configuration for use by both men and women. They are also variously configured for application to the crotch area of pants or to the axillary area of shirts and blouses or can be cut individually by a purchaser to be attached to such other inner surfaces of garments as the purchaser may wish. For instance, a purchaser who suffers from a skin disease or injury may apply a product of this invention to the inner surface of a garment adjacent to the injured or diseased area to provide comfort from abrasion of the skin area by the garment fabric.

BRIEF DESCRIPTION OF THE DRAWINGS

FIG. 1 is a top plan view of one embodiment of a product of this invention, particularly configured for application to the crotch area of pants worn by women.

FIG. 2 is a cross-sectional elevation view of a representative region of the product of FIG. 1.

DETAILED DESCRIPTION OF THE INVENTION

Figure 3:
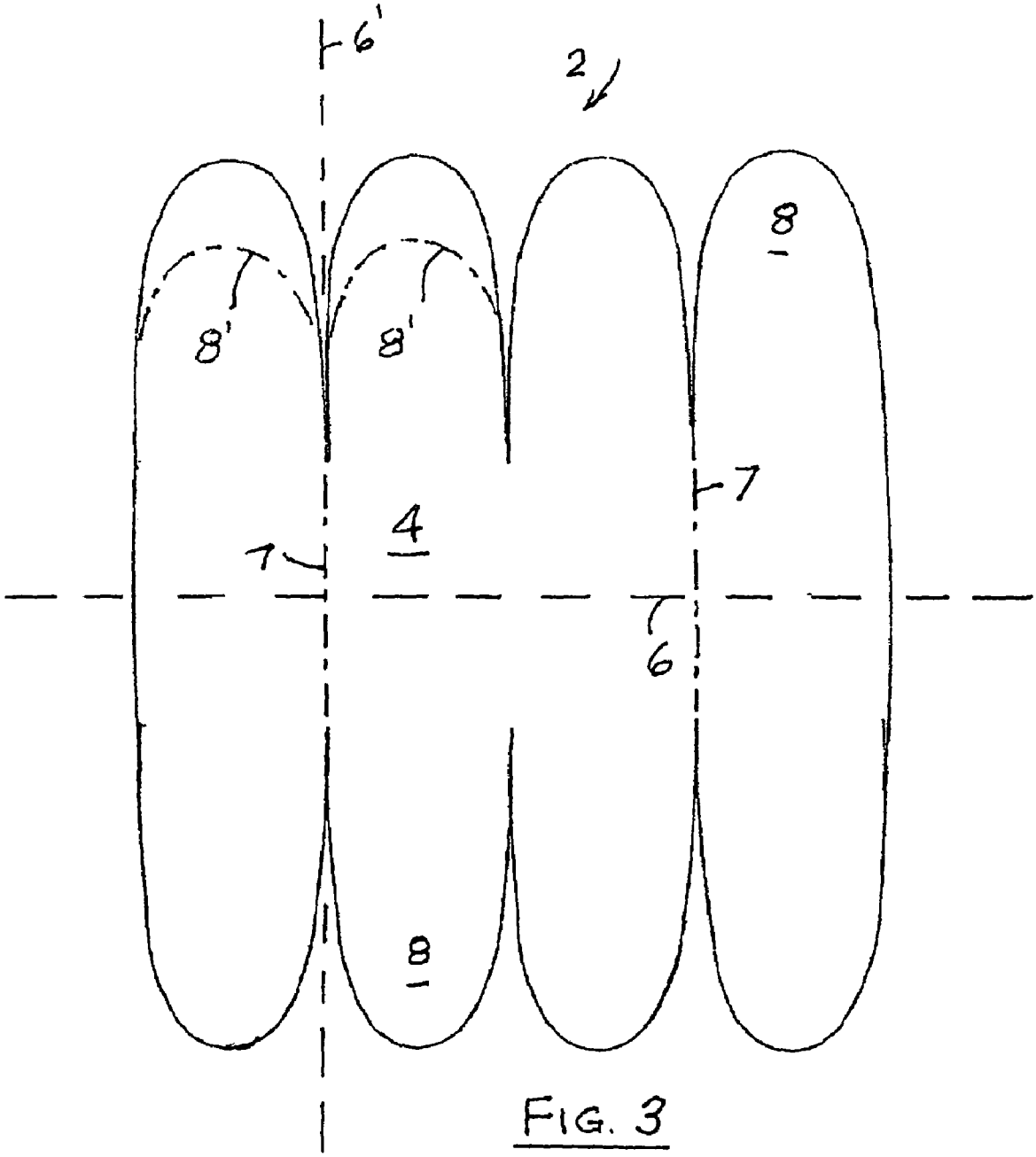
FIG. 3 is a top plan view of another embodiment of a product of this invention, particularly configured for application to the crotch area of pants worn by men.

As summarized above, each tibbidy product of the present invention is a lightweight fabric article which is configured to be flexible and to conform to the various curves of the inner surface of a garment, such as to the inner surface of the inseam and crotch of a pair of pants, such as jeans. The product is in the form of a multilayer flexible article having on one side thereof a soft comfortable pad, preferably an intermediate supporting member for the pad, and an adhesive layer on the opposite side of the pad or, where present, supporting member, for adhesion to the inner surface of the garment. A removable release layer is normally placed over the outer surface of the adhesive layer when the product is manufactured and packaged to prevent the adhesive from adhering to the packaging. The release layer is removed by the wearer after the individual product is removed from the packaging to be used, thus exposing the adhesive for attachment to the garment surface. (The overall article itself may sometimes be referred to by users as a "pad." It will be understood that for the purposes of this invention such use of the term "pad" is to be considered to be synonymous with "patch", "cushion" or other term that users may employ when referring to a soft, cushioning, protective article having the properties defined herein.)

The invention is best illustrated by the Figures of the drawings. Considering first the embodiments shown in FIGS. 1, 2 and 3, the example shown in FIG. 1 represents an embodiment particularly configured for attachment to the inner surface of the crotch of women's outer pants, especially to jeans. In FIG. 1 the product is generally designated 2, and comprises an article in the shape of a series of adjacent segments 4 each of which projects laterally from the centerline 6, which is indicated by a dashed line. Typically for products for women there will be 3-4 segments, but there may be more or less, and the segments may all be conjoined or abutted or some may be conjoined and some abutted (as shown further in FIG. 3). The product 2 of FIG. 1 is primarily used by being placed on the crotch inseam (not shown) of a pair of pants, such as jeans, or a similar garment with the seam aligned with the centerline 6 such that the lobes 8 formed by each segment 4 of the product extend outwardly onto the fabric of the garment (not shown). The flexible nature of the product material itself as well as the ability of the individual lobes 8 to flex generally independently of each other allows the product to flex, stretch and move easily as the wearer walks, bends or otherwise moves about and the outer garment fabric moves, flexes or stretches in conformance to the wearer's motions. Thus there is little or no tendency for the product to disengage from the outer garment since it can flex freely with the flexure of the outer garment. The segments 4 and lobes 8 are illustrated as generally elliptical in shape, but they may also be oval, circular or other rounded shapes. It is preferred that they not be rectangular or otherwise have squared off ends, since squared corners on the lobe ends will have a greater tendency to lift off the garment surface than will rounded ends, and rectangular shapes will often have only minimal clearance between adjacent lobes 8, which also will cause a greater tendency for the lobes to lift off the garment surface.

As also illustrated in FIG. 1, the product configuration can vary by having the lobes 8 extend to different lengths from the centerline 6 as illustrated by the phantom line 10. The lobes 8 may all be of the same length or they may have different lengths. The product may also vary by having different numbers of segments 4 as indicated by the phantom line 12. In a typical embodiment for women such as that shown in FIG. 1 the product is about 4-5 inches (10-12 cm) long along the centerline 6 and about 3½-4 inches (9-10 cm) wide between the tips of the lobes 8 of each segment. It will be evident that there can be variations in size so that wearers can select particular sizes of the product which best conform to their clothing sizes and to the bodily areas which they wish to protect from contact with the inner surface of the outer garment.

The tibbidy article 2 is shown in cross-section in FIG. 2 of the drawings. Facing the wearer's body is a flexible pad 14, which is a soft material, preferably a smooth or lightly fleeced material such as cotton, and comfortable to the wearer's skin. While the pad may be used alone, that is not preferred since many materials which are otherwise suitably soft for pad 14 do not have sufficient internal strength to resist repeated flexing of the garment fabric as the wearer moves about. Therefore it is preferred that the pad 14 be backed and supported by a support member 16. The support member 16, while also flexible, is made of a material which has sufficient strength to maintain its dimensions and integrity, to prevent stretching or tearing of the pad 14 and the product 2.

On the opposite side of the support member 16 from the pad 14 is an adhesive layer 18. The adhesive is chosen such that it will adhere to both the pad 14 (if the latter is used alone) or more preferably to the intermediate member 16 and also to the surface of typical garment fabrics such as denim without harming either material to which it is adhered. The adhesive must also be sufficiently adherent to stay in place throughout the movements of the wearer and the outer garment but yet be readily removable after use by the wearer. It is contemplated that the product will normally be used only once by a wearer and will be removed from the garment and disposed of after such use. The wearer would then use a fresh product the next time that he or she wants to wear the outer garment without any undergarments. The exposed surface of the adhesive layer 18 is initially covered with a release layer 20 which is commonly made of a coated or uncoated paper or a thin plastic film. The release layer 20 prevents the adhesive 18 from bonding to the product packaging or to any other surface after removal from the packaging until the wearer is ready to attach the pad product to the inside of the outer garment. At that time the wearer peels the removable release layer 20 away from the product to expose the adhesive surface and then places the adhesive surface against the inner surface of the garment at the desired location and presses the product in place to secure the adhesive to the garment. The wearer can then don the garment and proceed with any desired activities.

The top pad 14 will be formed of a soft material which is comfortable to the wearer and does not abrade or irritate the wearer's skin. The top pad material (as well as any intermediate member 16 and the adhesive 18) will preferably be hypoallergenic or otherwise medically suitable for skin contact. Numerous suitable commercial materials preferably made of cotton or blends of cotton with synthetic fabrics, such as fleeces, velours, woven interlocks and similar fabrics, are available. It is contemplated that several different fabrics will be commercially available with the product 2 to allow wearers to choose the particular fabric that they find the most comfortable. Typical preferred examples of useful and skin-compatible commercial fabrics for the top layer include 100% organic cotton, 100% interlock and combed cotton, cotton/polyester blend fleece with the double-brushed side being the face side of the top layer 14, and micromodal rayon/supima cotton jersey blend. It will be evident that there are numerous other criteria such as thickness and cost of the fabric which can be considered by the manufacturers and buyers of the product. Those skilled in the art will be readily able to identify suitable fabrics, and customer selection in the marketplace will quickly indicate the embodiments most preferred by the customers.

Figure 6:
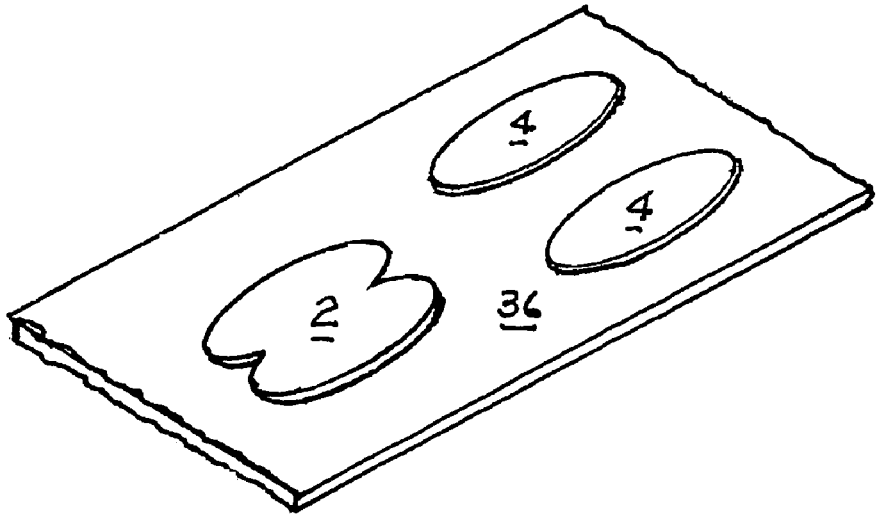
FIG. 6 is a view similar to that of FIG. 5 but illustrating that several individual segments 4 or complete or partial products 2 can also be provided in roll form.

In FIG. 2 the pad 14 and the support member 16 are shown separately for convenience in describing the invention pictorially. It will be recognized, however, that in many cases the layers 14 and 16 will be part of a single integrated commercial fabric, with a soft portion on top and a woven or similar backing material within or beneath to which the soft portion is attached. For the purposes of this invention the layers 14 and 16 described for the product 2 can be as separate layers of material or can be formed as a single unitary sheet material with in effect a "pad side" and "support side." An example of such an integrated material is illustrated in FIG. 6 and designated 14/16 (see detail A). Therefore, individual references herein to pad 14 and/or member 16 are to be considered also to include any integrated material as well, as appropriate in the context and unless the context dictates otherwise.

Preferably the adhesive layer 18 will be formed of a medical grade adhesive such as a solvent based acrylic adhesive. Other adhesives which are suitable but which may not be available as medical grade quality include aqueous based acrylics, silicone adhesives, rubber based adhesives and hot melt adhesives. All of the adhesives can be applied by either direct coating or machine lamination. The adhesive layer may also have an internal reinforcement so that the overall layer 18 is a double coated adhesive with a center layer of polyester film with the adhesive coated on both sides. The adhesive layer 18 must have a flexibility for movement, stretch and flexure at least as great as the flexibility of the fabric and backing layers 14 and 16. The adhesive, whether or not it is of medical grade quality, must of course also not be harmful to the wearer's skin so that if a pad 2 does become separated from the garment fabric and the adhesive contacts the wearer's skin it will not cause injury to the wearer. The adhesive must also have a degree of adhesion that will allow it to remain adhered to the fabric of the garment for the wearing period desired by the wearer, but still be able to be peeled from the garment without damage to the garment fabric or leaving any residual adhesive adhered to the fabric. There are numerous adhesives commercially available which have suitable degrees of adhesion and the appropriate selection will be readily apparent to the person skilled in the art.

The release layer 20 can be any suitable release paper or film product. We have found a single-layer bleached kraft liner paper which is coated on the adhesive contact side with a silicone-based release agent to be suitable. The release paper may be printed with a customer logo or other indicia and may have score cuts or a butterfly liner design similar to that used on bandages to aid the wearer in separating the release paper 20 from the adhesive layer 18 when preparing the product for use.

Figure 4:
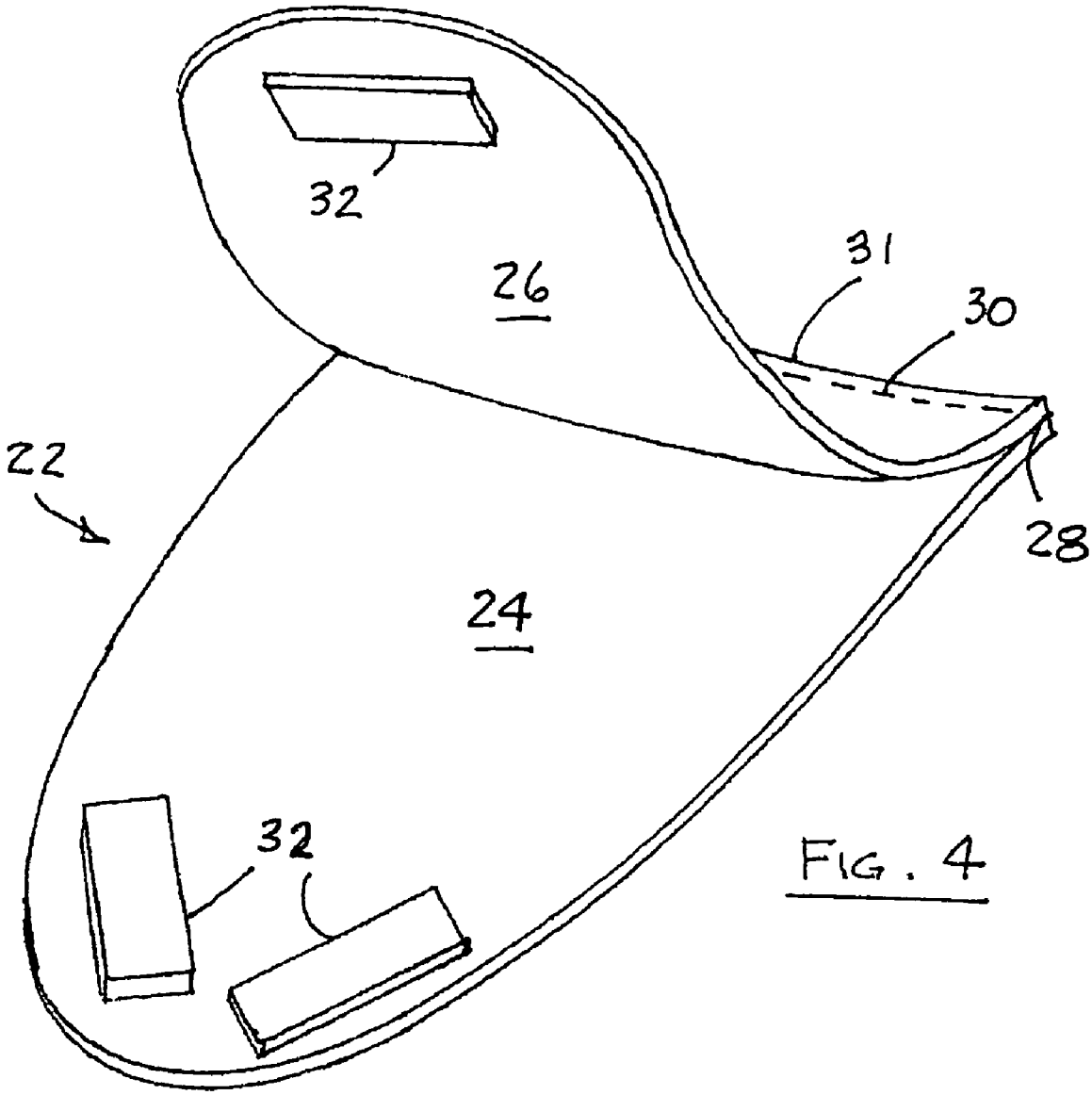
FIG. 4 is an oblique view of yet another embodiment of a product of this invention, particularly configured for application to the inner surface of the underarm area of a shirt or blouse where a sleeve attaches to the torso of the garment, and which is equally applicable to garments for males and females.

It is also contemplated that the adhesive layer 18 need not be a continuous layer. Rather the layer 18 may be formed of discrete islands or patterns of adhesive placed on the back of the intermediate backing layer 16, as is illustrated in the embodiment of FIG. 4. Such discontinuous or patterned application of adhesive is well known in the art.

Figure 5:
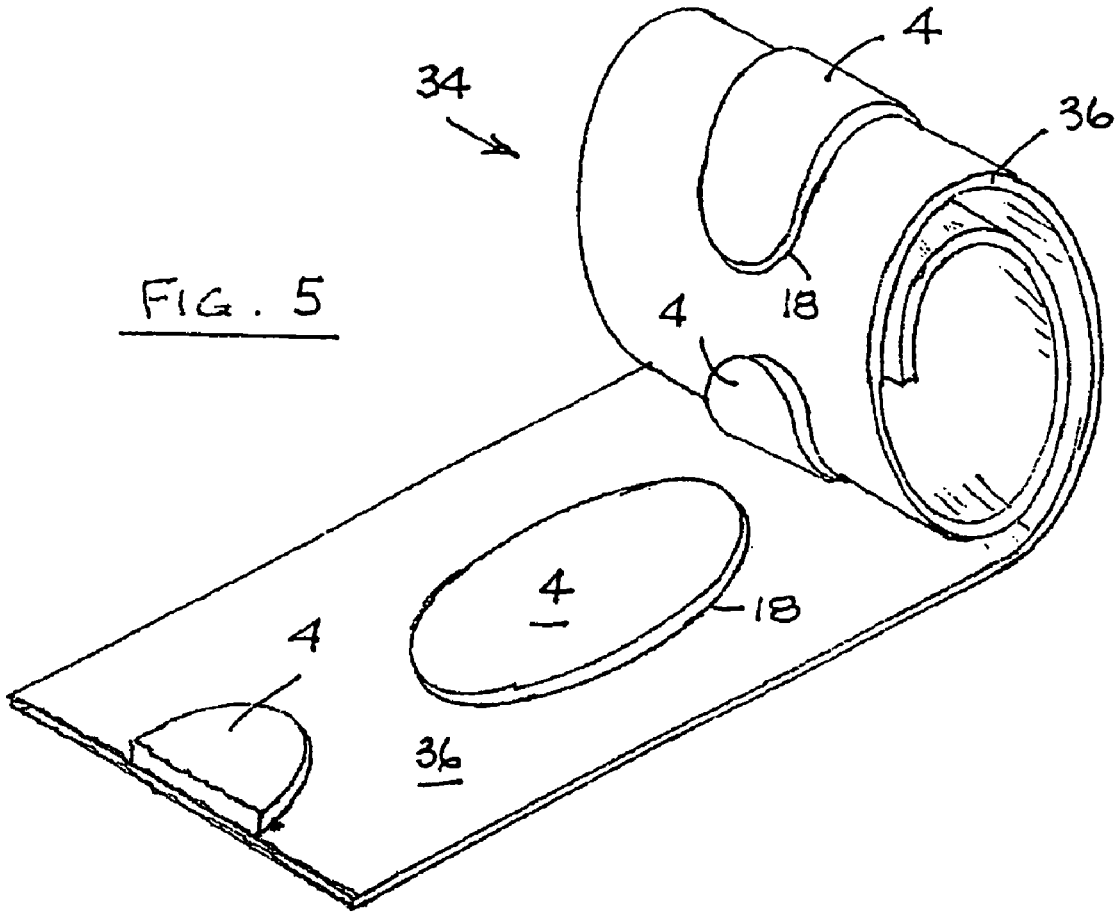
FIG. 5 is an oblique view of an embodiment of the invention wherein a plurality of individual segments of the products are releasably attached seriatim to a backing strip and wound into a roll, from which a desired number of the segments can be detached by a user as by peeling for assembly into a product of the user's desired shape, and also illustrating an embodiment of the invention particularly applicable for use by men.

FIG. 3, supplemented by FIGS. 5 and 6, illustrates an embodiment of the product 2 which is particularly configured for attachment to the inner surface of the crotch of men's outer pants, again especially to jeans. While the embodiments of FIGS. 1, 3 and 5 appear generally similar, it will be recognized that the differences in male and female genitalia may provide for more variation in length, width and orientation of the products for men than are expected for products for women. Examples of these are illustrated particularly in FIG. 3. For instance, the length for men's product will vary much more than in products for women. Consequently, in the embodiment of FIG. 3 the lobes 8 will be longer than those of the embodiment of FIG. 1, by up to several inches. Variation of lengths for different male users can be accommodated by having the lobes 8 be of a length which will be sufficient for most men, such that each male purchaser can then cut one or more of the lobes 8 to a shorter length 8" as desired or to bias the length to the leg of the pants to which he dresses. Typically also the products of this invention for use with men's pants will be of difference width than those used with women's pants, which may be accommodated either by making men's articles with wider segments 4 or with having more or less segments 4 than for women's products. In FIG. 3 the lines 7 represent alternative edges which illustrates that single segments 4 may be used independently and also that multiple segments can be assembled by conjoining (as with the two center segments and/or by abutment as with the two outer segments. Additionally, a man may need to have a product oriented differently with respect the crotch seam of his pants or jeans, as indicated by the alternative centerlines 6 and 6'. The men's product may be centered on the crotch seam as indicated by centerline 6 or it may be oriented generally parallel to the crotch centerline but on one or both sides thereof, as indicated by the centerline 6'. Those men who dress exclusively to one side of the crotch centerline may choose to attach the product only to that side of the crotch seam of their pants. All of these variations can be readily accommodated by the tibbidy products of this invention, such that notwithstanding such variations, the products of the various embodiments of the Figures will be equivalent with respect to materials, function and manner of use.

It will be recognized that the products of FIGS. 1-3, while discussed in their preferred embodiments as being primarily for women or primarily for men, need not be so limited in actual use. It is expected that each gender will find the embodiment preferred for it to be more comfortable and convenient than the other, but since the embodiments have identical functions, either embodiment may be used by either gender as desired.

FIG. 4 illustrates yet another embodiment of the invention, the embodiment being a product 22 configured for use with a shirt, blouse, jacket or other sleeved garment intended to be worn over the torso and shoulders. This embodiment is to be attached to the seam area of the sleeved garment where the sleeve is attached to the body of the garment, and which when the garment is worn is adjacent to the wearer's axillary area. The product 22 is formed of a body flap 24 which is attached at seam 28 to a sleeve flap 26, with the two flaps being secured preferably along the seam 28. The edge 31 bordering the seam 28 which as illustrated normally be cut in a curved shape to conform generally to the curved line of the sleeve/body seam of garment. Securement of the seam 28 is preferably by stitching 30, but other methods of securement, such as by adhesive or by thermal or solvent bonding, may also be used, but stitching is preferred as normally resulting in a finished seam which is more comfortable to the wearer, usually more flexible and less likely to separate in use. Typically the body flap 24 will be longer than the sleeve flap 26, often twice as long. This provides for a larger area for securement of the product to the garment along the body or torso of the garment and reduces the amount of the product which extends into the more restricted area of the sleeve. The product secured to the inside of both the body and sleeve of the garment by double-sided adhesive pads 32. The product is normally supplied to the purchaser with the pads 32 already adhered on one side to the inner surfaces of the flaps (the "inner" surfaces being designated as those surfaces which in use will face the garment rather than the wearer's skin), with the other side of each pad 32 being covered with a layer of release paper or similar material to protect the adhesive. The purchaser, when ready to use the product, then removes the release paper from each adhesive pad and attaches the product to the sleeve/body seam area of the garment. The product of this embodiment thus differs slightly from the embodiments of FIGS. 1-3, in that it will not have an overall multi-layer structure. Rather the adhesive and release paper will be disposed as discrete pads rather than being distributed over the entire inner surfaces of the product, and the main portions of the flaps will be of the soft fabric material comfortable to the wearer as described above.

The invention and its usage have been described above initially with respect to protection of the lower portion of a wearer's trunk and particularly the inguinal region, and with pants, jeans, shorts and similar lower body garments, since that is the focus of current fashion trends. Secondarily, it has been described for protection of the axillary region, where the products would be adhered to upper body garments such as shirts, blouses, jackets and the like. However, it will be evident that the products of the present invention can be used for attachment to an outer garment for protection of other regions of a wearer's body when an inner garment (including an inner garment commonly considered to be an "undergarment") is not worn beneath such outer garment. Such regions of the body may be, for instance, the nape of the neck, the insides of the knees and/or elbows, or the lumbar area of the back. Another anticipated application of the product is for attachment to the inner surface of the front of a woman's upper garment, such as a blouse, sweater, tank top, tee shirt or jacket, in line with the garment wearer's breasts, to prevent irritation of sensitive aureolar and nipple regions. This application may be of particular interest to women who have undergone breast augmentation procedures. Additionally, in a medical setting a purchaser who suffers from a skin disease or injury or who has undergone disruptive skin treatments or surgical procedures such as skin grafts or mastectomies may apply a product of this invention to the inner surface of an outer garment adjacent to the injured, affected or diseased area to provide comfort from abrasion of the skin by the garment fabric when an inner garment cannot be or is not desired to be worn over the injured, affected or diseased area.

Figure 7:
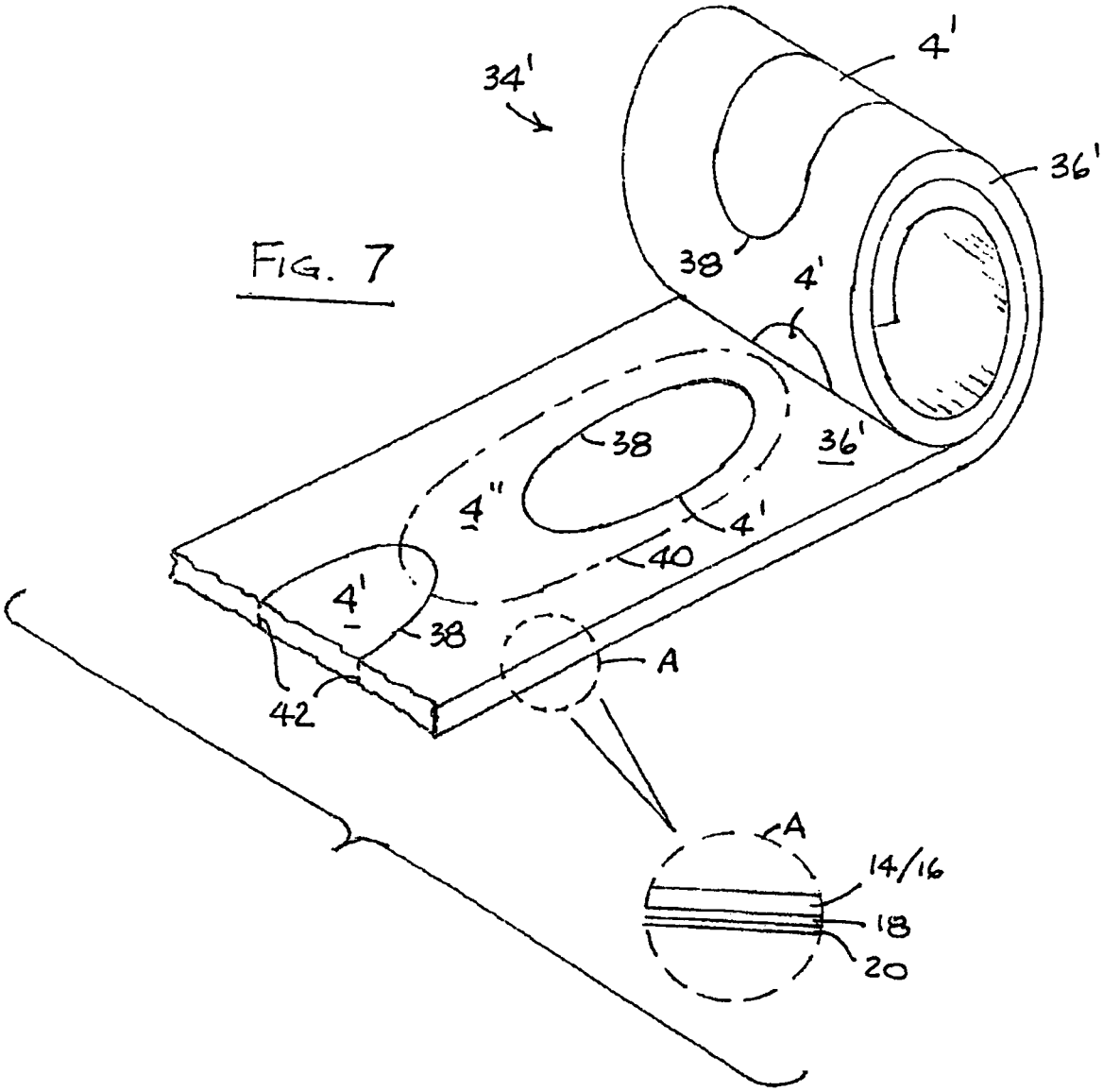
FIG. 7 is a view similar to FIG. 5 but in which the segments are to be separated or cut from the roll rather than being detached as by peeling.

It is contemplated that in most cases packaging for the articles of this invention will comprise an individual envelope, pouch or similar container for each individual product or plurality of products. However, FIGS. 5, 6 and 7 illustrate two other useful systems of packaging and dispensing of the products of this invention. In both of the systems illustrated in these Figures, there is a roll 34 or 34' formed of an elongated strip 36 or 36' which holds a plurality of individual segments (indicated as 4 in FIGS. 1 and 3) of a product, particularly an inguinal-area product. In FIG. 5 the strip 36 is a single layer of release paper or similar material, to which the individual segments (designated 4') are adhered by their adhesive layers 18. The purchaser of the roll 34 unrolls a length of the roll and peels off as many of the segments 4' as he or she wishes to combine to form the product of invention for that particular use. The separated segments 4' may then be adhered to the desired garment either singly or in abutted alignment to form the resulting product. Alternatively, as shown in FIG. 6, two or more segments 4 and/or complete or partial products 2 comprising two or more conjoined segments 4 can be disposed laterally across the strip 36.

The system of FIG. 7 works in a similar manner, except that in this case the rolled strip 36' is a large sheet of the material as illustrated in FIG. 2, such that complete individual segments can be separated from or cut from the strip 36'. (The structure of the material is indicated in the enlargement detail at A in FIG. 7.) The strip 36' will have indicia 38 marked on it to outline the proper shape of a particular segment 4' which the purchase can then cut from the strip 36' with scissors, a knife, razor, or the like using the indicia 38 as a guide. It is not required that the purchaser adhere to the guide indicia. As indicated at 40 a purchaser can alternatively cut a segment 4" of any size or shape, if desired. Alternative, in the system of FIG. 7 the individual segments 4' may be pre-cut by die- or laser-cutters in a conventional manner, as indicated at dotted lines 42, so that all the purchaser has to do is to punch the pre-cut segments from the strip 36'.

It will be evident that there are numerous embodiments of the invention which are not expressly described above, but which are clearly within the scope and spirit of the invention. The description herein is therefore to be considered exemplary only, and the actual scope of the invention is to be determined solely from the appended claims, as may be interpreted by the specification herein.

We claim:

1. An underwear substitute article, comprising:

a flexible pad comprising four integral parallel equal-length elliptical segments each terminating in independent opposing lobes projecting perpendicularly away from a centerline of the flexible pad, the flexible pad having a top layer with a napped top surface and an integral woven bottom layer, the integral woven bottom layer having an adhesive backing;

wherein when the flexible pad is adhered to a crotch of an inner surface of a garment, the centerline of the flexible pad is aligned with an inseam of the crotch, the independent opposing lobes of the four elliptical segments are adhered to the inner surface of the garment on opposing sides of the inseam, and the independent opposing lobes flex independently of one another as the inner surface of the garment flexes.

2. An underwear substitute system, comprising:

an outer garment having an inner surface with a crotch and an inseam; and a flexible pad adhered to the crotch of the inner surface of the outer garment, the flexible pad having a centerline aligned with the inseam of the outer garment, the flexible pad comprising:

four integral parallel equal-length elliptical segments each terminating in independent opposing lobes projecting perpendicularly away from the inseam of the outer garment;

a top layer with a napped top surface; and a woven bottom layer integral with the top layer, the woven bottom layer having an adhesive backing;

wherein the independent opposing lobes of the four elliptical segments are adhered to the inner surface of the garment on opposing sides of the inseam; and wherein the independent opposing lobes flex independently of one another as the inner surface of the garment flexes.

* * * * *